US006009857A

United States Patent [19]

Hasler et al.

[11] Patent Number: 6,009,857

[45] Date of Patent: Jan. 4, 2000

[54] COMPRESSION IGNITION CYLINDER CUTOUT SYSTEM FOR REDUCING WHITE SMOKE

[75] Inventors: Gregory S. Hasler, Pekin; Stephen C. Nofsinger, Washington, both of Ill.

[73] Assignee: Caterpillar Inc., Peoria, Ill.

[21] Appl. No.: 08/865,519

[22] Filed: May 29, 1997

[51] Int. Cl.[7] ..... F02D 17/02

[52] U.S. Cl. ..... 123/481

[58] Field of Search ..... 123/198 F, 481

[56] References Cited

U.S. PATENT DOCUMENTS

| | | | |
|---|---|---|---|
| 3,815,563 | 6/1974 | Stinsa | 123/198 F X |
| 3,896,779 | 7/1975 | Omori et al. | 123/198 F X |
| 4,150,651 | 4/1979 | Wade et al. | 123/198 F X |
| 4,274,382 | 6/1981 | Sugasawa et al. | 123/481 |
| 4,276,863 | 7/1981 | Sugasawa et al. | 123/481 |
| 4,499,876 | 2/1985 | Yamamoto | 123/198 F X |
| 4,552,114 | 11/1985 | Sano et al. | 123/481 |
| 4,676,214 | 6/1987 | Kato et al. | 123/446 |
| 4,928,642 | 5/1990 | Atkinson et al. | 123/179.7 |
| 5,035,212 | 7/1991 | Hudson et al. | 123/323 |
| 5,105,779 | 4/1992 | Thompson | 123/198 F |
| 5,117,790 | 6/1992 | Clarke et al. | 123/321 |
| 5,251,590 | 10/1993 | Faletti et al. | 123/179.21 |
| 5,445,128 | 8/1995 | Letang et al. | 123/436 |
| 5,445,129 | 8/1995 | Barnes | 123/446 |
| 5,483,927 | 1/1996 | Letang et al. | 123/41.12 |
| 5,564,391 | 10/1996 | Barnes et al. | 123/446 |

OTHER PUBLICATIONS

Benefits of New Fuel Injection Sys. Tech. on Cold Startability of Diesel Engines—SAE Technical Paper Series #940586 (1994).

*Primary Examiner*—Tony M. Argenbright
*Attorney, Agent, or Firm*—R. Carl Wilbur

[57] ABSTRACT

The invention is a method for a cylinder cutout system in a compression ignition engine utilizing a plurality of electronic unit injectors. An electronic controller, in communication with the compression ignition engine, is configured to receive a plurality of sensor signals indicative of current engine operating parameters. In response to the received signals, the electronic controller produces an injector signal. Included in each of the electronic unit injectors is a solenoid, that when activated in response to the injector signal received from the electronic controller, will facilitate injection of fuel to a corresponding cylinder. A predetermined plurality of the electronic unit injectors will be deactivated in response to the injector signal.

24 Claims, 3 Drawing Sheets

COMPRESSION IGNITION CYLINDER CUTOUT SYSTEM FOR REDUCING WHITE SMOKE

TECHNICAL FIELD

This invention relates generally to an engine control and more particularly to a system and method for reducing white smoke from the exhaust of a compression ignition engine.

BACKGROUND ART

In compression ignition engines, the fuel injected into the cylinders is ignited from the heat generated by compression. If ignition fails to occur the fuel is expelled through the engines exhaust system. The vaporized, unburned fuel is typically called white smoke. The reduction of white smoke is desirable, due in part, to the ever increasing consumer and governmental requirements for fuel economy, performance, and emissions.

An example of a system directed toward reducing white smoke is shown in U.S. Pat. No. 4,928,642 issued to Atkinson on May 29, 1990. The Atkinson patent discloses a system for automatically injecting a starting fluid, during engine cranking and for a period of time after the engine starts, based on one or more engine parameters. Injecting the starting fluid during the starting period lowers the flash point of the air/fuel mixture in the engine combustion chamber, thereby causing the fuel to burn more completely and reduce the white smoke emissions.

Another example of a system directed toward reducing white smoke is U.S. Pat. No. 5,035,212 issued to Hudson on Jul. 30, 1991. The Hudson patent discloses an apparatus for an exhaust restrictor designed to reduce white smoke during low idle conditions, such as a marine boat trolling in low idle. The exhaust restrictor includes a valve connected to the exhaust system and the intake system. The valve includes a housing having a through passage to the exhaust system and the intake system. A shaft is rotatably positioned in the housing. A plate is attached to the shaft. The plate is positioned in the passage and is movable between an opened position and a closed position. A mechanical linkage is connected to the throttle and the shaft. The linkage will move the plate into a exhaust restricting position corresponding with the throttle being moved into a low idle position.

The system disclosed in the Atkinson patent and the Hudson patent both require the addition of a mechanical means, such as a starting fluid injector setup or a exhaust restrictor system including a plate mechanically linked with a throttle, to function. The addition of the mechanical means may increase the cost and complexity of the system.

An example of a method for electronically controlling the fuel injection rate and fuel injection duration is disclosed in U.S. Pat. No. 5,445,129 issued to Barnes on Aug. 29, 1995. The Barnes patent discloses, in part, a method for fuel to be injected in a series of very short bursts, which may provide for lower emissions and white smoke reduction. However, the Barnes patent does not disclose a cylinder cutout system dedicated to reducing white smoke.

The present invention is directed to overcoming one or more of the problems as set forth above.

DISCLOSURE OF THE INVENTION

In one aspect of the present invention a method for a compression ignition engine cylinder cutout system is disclosed. The compression ignition engine includes a plurality of electronic unit injectors in communication with an electronic controller. The electronic controller is configured to receive a plurality of sensor signals indicative of engine operating parameters. A plurality of predetermined values, indicative of desired engine operating parameters, are stored in a memory included in the electronic controller. At least one of the plurality of received sensor signals is compared with at least one of the corresponding predetermined values. The electronic controller is configured to terminate fuel delivery to at least one of the plurality of electronic unit injectors in response to the comparison.

These and other aspects and advantages of the present invention, as defined by the appended claims, will be apparent to those skilled in the art from reading the following specification in conjunction with the drawings and the claims.

BRIEF DESCRIPTION OF THE DRAWINGS

For a better understanding of the invention, reference may be made to the accompanying drawings, in which.

BEST MODE FOR CARRYING OUT THE INVENTION

Figure 1A:
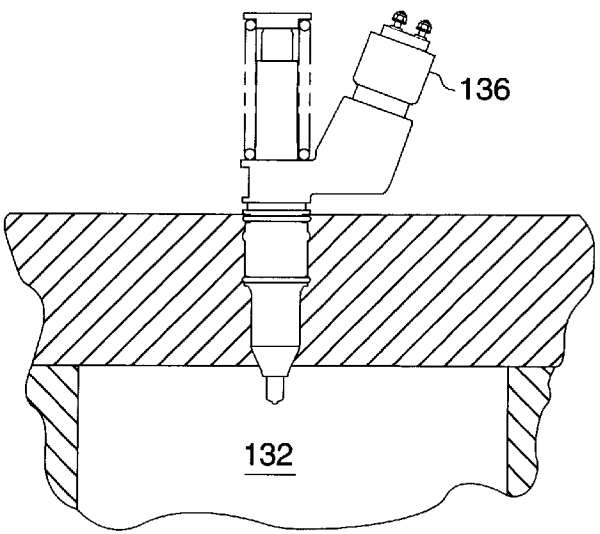
FIG. 1*a* is an enlarged view of a portion of the system level block diagram of FIG. 1.
Figure 1:
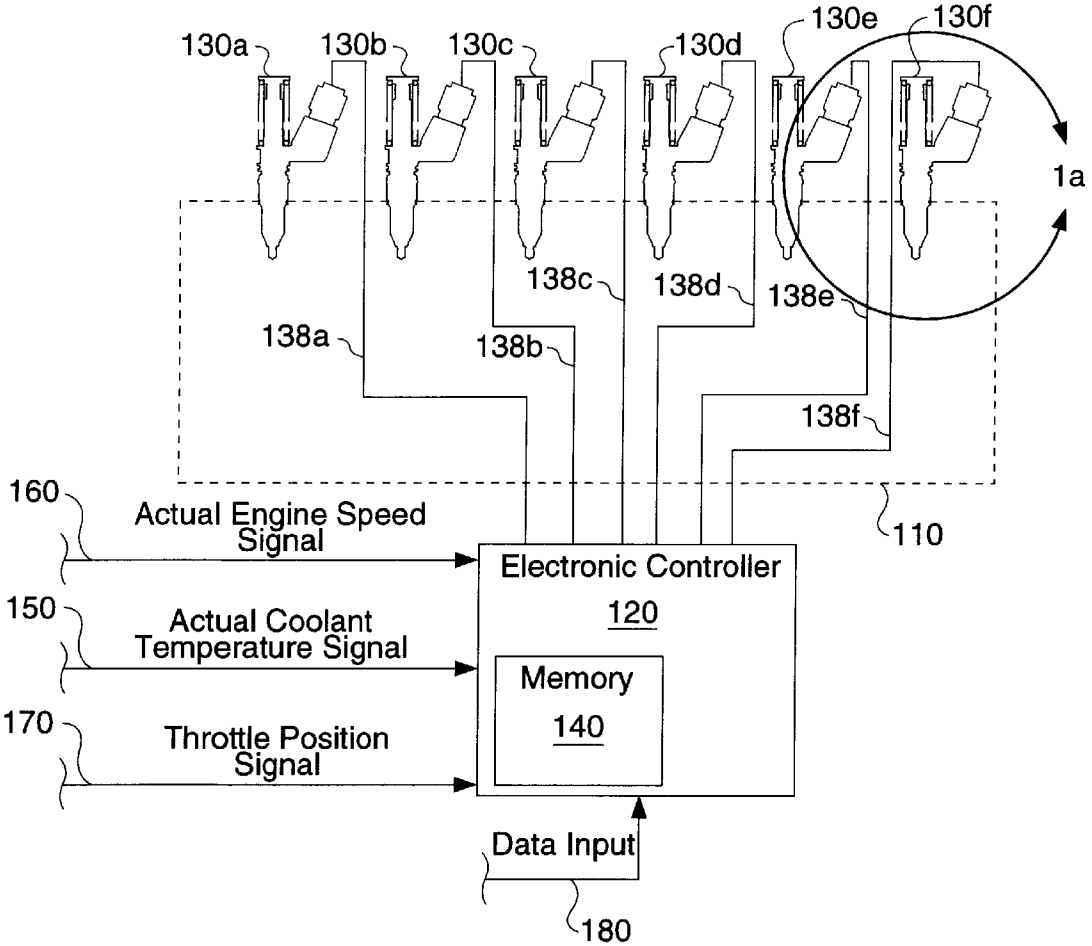
FIG. 1 is a system level block diagram illustrating a preferred embodiment of the cylinder cutout system of the present invention.

Referring to FIG. 1, a block diagram illustrating a preferred embodiment of the cylinder cutout system is shown. The cylinder cutout system includes a compression ignition engine 110, an electronic controller 120, and a plurality of electronic unit injectors 130*a–f*. The electronic controller 120 is in communication with each of the electronic unit injectors 130*a–f*. A memory 140 is included in the controller 120.

The electronic controller 120 receives sensor signals indicative of engine operating parameters. For example, in a preferred embodiment of the present invention, an engine speed signal 160 is an input to the electronic controller 120 from a camshaft speed/timing sensor associated with the engine. Additional signals may also be provided as inputs to the electronic controller 120, some examples being a coolant temperature signal 150 from a coolant temperature sensor, and a throttle position signal 170 from a throttle position sensor. The sensors for these signals are not shown in FIG. 1. However, the use of such sensors in connection with an engine is well known in the art. One skilled in the art could easily and readily implement such sensors in connection with an engine using the present invention.

A data input 180 to the electronic controller 120 is also provided. In the preferred embodiment a variety of predetermined operating parameters, one example being an engine low idle speed value, may be programmed into the electronic controller 120 at the factory. The predetermined operating parameters may optionally be delivered to the electronic controller 120 through the data input 180 by a programming tool (not shown), such as a lap top computer or a liquid crystal display screen with an alphanumeric key pad.

Each of the electronic unit injectors 130*a–f* includes a control solenoid 136 and a corresponding cylinder 132, as shown in FIG 1*a*. Also, each of the electronic unit injectors 130*a–f* are individually connected to outputs of the electronic controller 120 by electrical connectors 138*a–f* respectively. As is known in the art, an injector signal from the electronic controller 120 independently activates the control solenoid 136 on each electronic unit injector 130*a–f*. When the control solenoid 136 is activated, fuel is injected into the corresponding cylinder 132.

Although, the preferred embodiment is discussed with respect to a six cylinder compression ignition engine, one skilled in the art could readily implement the present invention in connection with a compression ignition engine that utilizes a different number of cylinders, such as eight cylinders or sixteen cylinders.

In a preferred embodiment the full range of engine operating speeds are divided into three ranges. For example, from 0–200 RPM the compression ignition engine 110 is said to be cranking (cranking speed range). Once the compression ignition engine 110 fires, then the compression ignition engine speed accelerates from compression ignition engine cranking speeds to compression ignition engine running speeds (acceleration speed range). Once the compression ignition engine speed reaches a predetermined compression ignition engine RPM, e.g. 1,200 RPM, then the compression ignition engine 110 is said to be running (running speed range). Thus the three defined operating ranges are:

1) cranking speed range of 0 RPM to 200 RPM
2) acceleration speed range of 200 RPM to 1,200 RPM
3) running speed range of 1,200 RPM to maximum RPM for given ignition engine.

Figure 2:
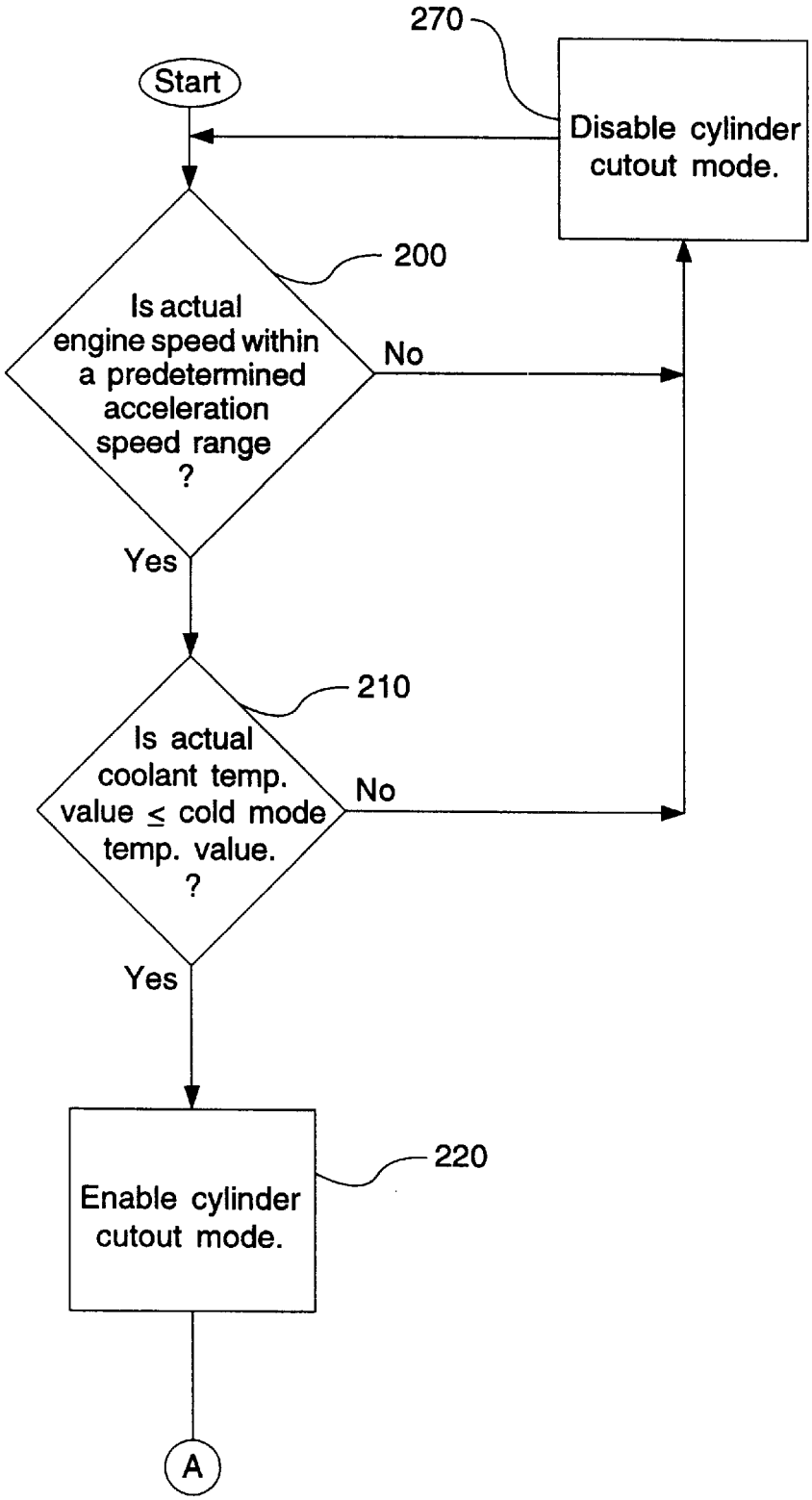
FIGS. 2 and 3 are a flowchart illustrating a preferred embodiment of the software control implemented by the cylinder cutout system.

Referring to FIG. 2, a flowchart of a preferred embodiment of the software control used in connection with cylinder cutout system is shown. In the first decision block 200, the electronic controller 120 determines if the actual engine speed value is within the acceleration speed range. If the actual engine speed value is within the acceleration speed range, control will pass to the next decision block 210.

In the next decision block 210, an actual coolant temperature value is compared to a predetermined cold mode temperature value. The actual coolant temperature indicates the current temperature of the compression ignition engine 110. The cold mode temperature value, in the preferred embodiment, represents a predetermined coolant temperature value indicative of a cold compression ignition engine 110 operating temperature, e.g. 18° Celsius. The cold mode temperature value is stored in the memory 140.

If, the actual coolant temperature value is less than the cold mode temperature value, control will pass to the next command block 220, and the cylinder cutout mode is enabled. If either, the actual engine speed is not within the acceleration speed range, or the actual coolant temperature value is greater than the cold mode temperature value, control will pass to the disable cylinder cutout mode command block 270, and the cylinder cutout mode is disabled.

As is known in the art, the electronic unit injectors 130*a–f* each contain a control solenoid 136 to initiate and terminate injection. The control solenoid 136 is energized by an injector signal from the electronic controller 120. An individual cylinder 132 is effectively cutout when the injection is terminated. In the preferred embodiment, the cylinder cutout mode enabled means that the electronic controller 120 prevents fuel delivery to roughly one half the engine cylinders. For example, in a six cylinder engine, 3 of the 6 electronic unit injectors 130*a–f* would be cutout. In the preferred embodiment, every other electronic unit injector 130*a–f*, such as 130*a*, 130*c*, and 130*e* shown in FIG. 1, would be cutout.

Although, the preferred embodiment is discussed with respect to cutting out 3 of the 6 electronic unit injectors, one skilled in the art could readily implement the present invention in connection with an engine that utilizes a different number of electronic unit injectors. For example, in a compression ignition engine with 8 cylinders, when the cylinder cutout mode is enabled, 4 of the 8 electronic unit injectors may be cutout.

Figure 3:
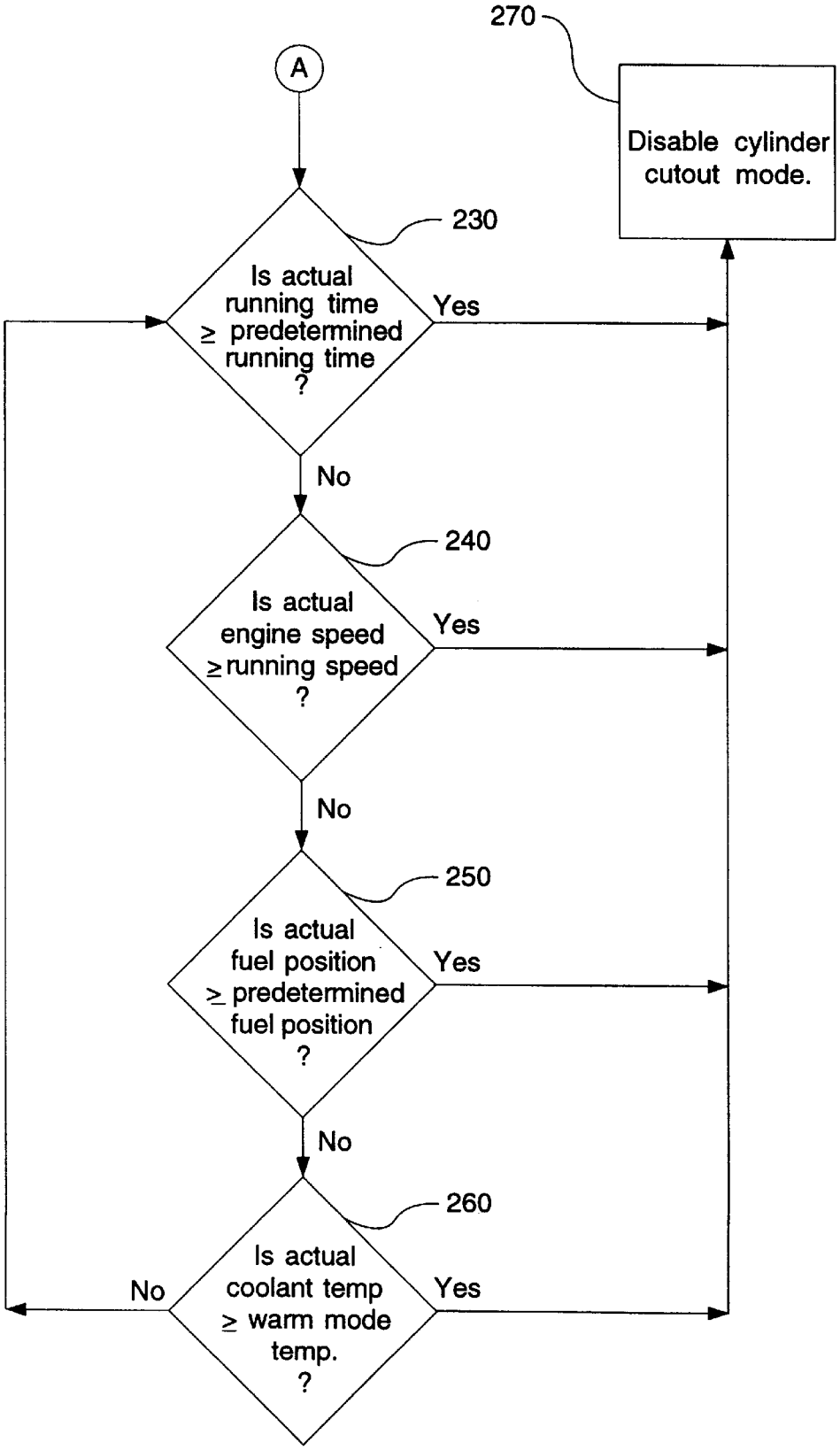

Referring now to FIG. 3, after the cylinder cutout mode has been enabled, control will pass to the next decision block 230, and the electronic controller 120 determines the actual length of time the compression ignition engine 110 has been running, (determined by a electronic timer, not shown, associated with the electronic controller 120) and compares that time to a predetermined running time value. If the actual running time value is equal to or greater then the predetermined running time value, control will pass to the disable cylinder cutout mode command block 270, and the electronic controller 120 will disable the cylinder cutout mode. By disabling the cylinder cutout mode, the electronic controller 120 will begin to fuel all cylinders again. If, the electronic controller determines the actual running time value is less then the predetermined running time value, control will pass to the next decision block 240.

In the next decision block 240, the electronic controller 120 determines what the actual engine speed value is, and compares the actual engine speed value to the running speed value. In a preferred embodiment, the running speed value is the minimum value of the running speed range, e.g. 1,200 RPM. The actual engine speed value is the compression ignition engine's current rotational speed as determined by the actual engine speed signal 160. If, the actual engine speed value is equal to or greater than the running speed value, the control will pass to the disable cylinder cutout mode command block 270, and the electronic controller 120 will disable the cylinder cutout mode. If the actual engine speed value is less than the running speed value, control will pass to the next decision block 250.

An injector signal, produced by the electronic controller 120, independently energizes the control solenoid 136 on each electronic unit injector 130*a–f* causing the initiation and termination of fuel injection into each corresponding cylinder 132. The electronic controller 120 utilizes the actual engine speed signal 160 and the desired engine speed signal in determining the injector signal. The desired engine speed value will increase when the throttle position signal 170 indicates an increase in the throttle position.

An actual fuel position value is determined by the electronic controller 120. The actual fuel position value represents the quantity of fuel needed to be injected into the cylinders 132 for the compression ignition engine 110 to advance from the actual engine speed to the desired engine speed under the current load conditions. As is known in the art, the electronic controller 120 utilizes the engine speed signal 160 to aid in determining an actual engine speed, and a throttle position signal 170 to aid in determining a desired engine speed. The actual fuel position value should increase or decrease in correspondence with the increase or decrease in the desired engine speed value.

In the next decision block 250, the electronic controller compares the actual fuel position value to a predetermined fuel position value. The predetermined fuel position value represents a corresponding desired engine speed value equal to or greater than what is desirable under cutout mode conditions. The predetermined fuel position value is stored in the memory 140. If, the electronic controller 120 determines the actual fuel position value is equal to or greater than the predetermined fuel position value, the control passes to the disable cylinder cutout mode command box 270, and the electronic controller 120 disables the cylinder cutout mode. If, the actual fuel position value is less than the predetermined fuel position value, the control passes to the next decision box 260.

In the next decision box 260, the electronic controller 120 will compare the actual coolant temperature value to a warm mode temperature value. The warm mode temperature value, in the preferred embodiment, represents a predetermined compression ignition engine temperature, e.g. 20° Celsius. The warm mode temperature value is stored in the memory 140. The cylinder cutout mode will be disabled if the actual temperature value is equal to or greater than the warm mode temperature value.

If, the actual temperature value is less than the warm mode temperature value, the control path will loop back to the decision block 230, and the process as described above, repeats itself. The cylinder cutout mode will remain enabled until one of the following occurs; the actual running time value is equal to or greater than the predetermined running time value, the actual engine speed value is equal to or greater than the running speed value, the actual fuel position value is equal to or greater than the predetermined fuel position value, or the actual temperature value is equal to or greater than the warm mode temperature value.

When the cylinder cutout mode is disabled, an injector signal from the electronic controller 120 independently activates the control solenoid 136 on all the electronic unit injectors 130*a–f*. In a preferred embodiment, when the control solenoid 136 is activated, fuel is injected into all 6 of the corresponding cylinders 132.

Industrial Applicability

The engine control disclosed herein, is preferably used on engines that may be susceptible to producing white smoke during operation. By using the present invention the control will help reduce white smoke during times of operating at a low engine speeds or when the engine is cold. For example, one particular application is in nautical vessels, such as a fishing boat or a marine pleasure craft. A marine pleasure craft usually operates at low engine speeds while maneuvering around boat docks or other obstacles in the water. Another application is after an engine is initially turned on and is operating while cold. Also, in some applications of high performance engines due to the high coolant efficiency, the engine temperature at low engine speed operations will become cool enough to cause white smoke to occur, such as a fishing boat trolling for fish.

We claim:

1. A method for controlling fuel delivery to an engine having at least two parameters and at least two cylinders, comprising:

sensing at least two engine parameters;

comparing the engine parameters to respective predetermined values;

delivering fuel to at least some of the cylinders at all times when the engine is running; and terminating fuel delivery to a fractional number of the cylinders in response to the at least two engine parameters having a predetermined relationship with respect to the respective predetermined values, the fractional number being a number less than one and greater than zero, and the termination of fuel delivery to all of the cylinders not occurring.

2. The method as set forth in claim 1, further comprising:

sensing a cutoff mode disabling parameter;

comparing the cutoff mode disabling parameter to a third predetermined value; and activating fuel delivery to the cylinder in response to the cutoff mode disabling parameter having a predetermined relationship with respect to the third predetermined value.

3. The method as set forth in claim 1 wherein the at least two engine parameters comprise:

a coolant temperature; and an engine speed.

4. The method as set forth in claim 3 wherein the predetermined values comprise:

a predetermined cold mode temperature value; and an acceleration speed range;

and the fuel delivery to the cylinder is terminated when the coolant temperature is less than or equal to the predetermined cold mode temperature value and the engine speed is within the acceleration speed range.

5. The method as set forth in claim 2 wherein the cutoff mode disabling parameter comprises a running time, and the fuel delivery is activated when the running time is greater than or equal to a predetermined running time.

6. The method as set forth in claim 2 wherein the cutoff mode disabling parameter comprises an engine speed, and the fuel delivery is activated when the engine speed is greater than or equal to a running speed.

7. The method as set forth in claim 2 wherein the cutoff mode disabling parameter comprises a fuel delivery command value, and the fuel delivery is activated when the fuel delivery command value is greater than or equal to a predetermined fuel delivery command value.

8. The method as set forth in claim 2 wherein the cutoff mode disabling parameter comprises a coolant temperature, and the fuel delivery is activated when the coolant temperature is greater than or equal to a warm mode temperature value.

9. The method of claim 1 wherein the fractional number comprises ½.

10. An apparatus for a cylinder cutout system on an engine, comprising:

a plurality of electronic unit injectors coupled to the engine; and an electronic controller coupled to the plurality of electronic unit injectors, the electronic controller configured to receive at least two signals indicative of respective engine parameters and to terminate fuel delivery by a fractional number of the electronic unit injectors responsive to the engine parameters being in respective first states, the respective first states being within a normal operating range for the respective engine parameter, the electronic controller further configured to activate fuel delivery by at least one other of the electronic unit injectors at all times when the engine is running, and the fractional number being a number less than one and greater than zero.

11. The apparatus of claim 10 wherein the engine parameters comprise engine speed and coolant temperature.

12. The apparatus of claim 11 wherein the engine speed parameter is in the first state when the engine speed is within a predetermined acceleration speed range, and the coolant temperature is in the first state when the coolant temperature is less than or equal to a cold mode temperature value.

13. The apparatus of claim 10 wherein the controller is further configured to reactivate fuel delivery by the electronic unit injectors responsive to a cutoff mode disabling parameter being in a second state.

14. The apparatus of claim 13 wherein the cutoff mode disabling parameter comprises engine running time, and the engine running time is in the second state when the running time is greater than or equal to a predetermined running time.

15. The apparatus of claim 13 wherein the cutoff mode disabling parameter comprises engine speed, and the engine speed is in the second state when the engine speed is greater than or equal to a predetermined running speed.

16. The apparatus of claim 13 wherein the cutoff mode disabling parameter comprises fuel position, and the fuel position is in the second state when the fuel position is greater than or equal to a predetermined fuel position.

17. The apparatus of claim 13 wherein the cutoff mode disabling parameter comprises a coolant temperature, and the coolant temperature is in the second state when the coolant temperature is greater than or equal to a warm mode temperature value.

18. The apparatus of claim 10 wherein the fractional number comprises ½.

19. A method for controlling fuel delivery to an engine having an engine speed, a coolant temperature, and at least two cylinders, comprising:

sensing the engine speed;

sensing the coolant temperature;

comparing the engine speed to a first predetermined value;

comparing the coolant temperature to a second predetermined value;

delivering fuel to at least one of the cylinders at all times when the engine is running; and terminating fuel delivery to a fractional number of the cylinders in response to the engine speed having a predetermined relationship with respect to the first predetermined value, and the coolant temperature having a predetermined relationship with respect to the second predetermined value, the fractional number being a number less than one and greater than zero, and the termination of fuel delivery to all of the cylinders not occurring.

20. The method as set forth in claim 19, further comprising:

sensing a running time of the engine;

comparing the running time of the engine to a predetermined value; and reactivating fuel delivery to the first cylinder in response to the running time being greater than or equal to a predetermined value.

21. The method as set forth in claim 19, further comprising:

sensing the engine speed of the engine;

comparing the engine speed to a predetermined value; and reactivating fuel delivery to the first cylinder in response to the engine speed being greater than or equal to a predetermined value.

22. The method as set forth in claim 19, further comprising:

sensing a fuel position of the engine;

comparing the fuel position to a predetermined fuel position; and reactivating fuel delivery to the first cylinder in response to the fuel position being greater than or equal to the predetermined fuel position.

23. The method as set forth in claim 20, further comprising:

sensing the coolant temperature of the engine;

comparing the coolant temperature to a predetermined value; and reactivating fuel delivery to the first cylinder in response to the coolant temperature being greater than or equal to the predetermined value.

24. The method of claim 19 wherein the fractional number comprises ½.

* * * * *